United States Patent [19]

Napolitano

[11] Patent Number: 4,493,607

[45] Date of Patent: Jan. 15, 1985

[54] TEE-TYPE VALVE FOR SELF-PRIMING PUMP SYSTEM

[75] Inventor: Pellegrino E. Napolitano, Middletown, N.J.

[73] Assignee: Hudson Engineering Company, Bayonne, N.J.

[21] Appl. No.: 450,442

[22] Filed: Dec. 16, 1982

[51] Int. Cl.[3] ..... F04D 27/00

[52] U.S. Cl. ..... 415/11

[58] Field of Search ..... 415/11, 26, 27, 28; 417/199 A, 278

[56] References Cited

U.S. PATENT DOCUMENTS

| | | | |
|---|---|---|---|
| 2,470,565 | 5/1949 | Loss | 415/11 |
| 3,370,604 | 2/1968 | Napolitano | 415/11 |
| 3,381,618 | 5/1968 | Napolitano | 415/11 |
| 4,255,079 | 3/1981 | Piegza | 415/11 |
| 4,290,979 | 9/1981 | Sugiura | 416/26 |

*Primary Examiner*—Henry C. Yuen
*Assistant Examiner*—John Kwon
*Attorney, Agent, or Firm*—Fleit, Jacobson, Cohn & Price

[57] ABSTRACT

A self-priming system for liquid pumps wherein a priming valve is provided to convey a quantity of priming liquid to the pump upon loss of pump suction. A pilot valve is provided to regulate the pressure against a piston which serves to maintain the priming valve closed. The pilot valve includes a bleed valve to vary the liquid pressure exerted against the piston and thereby regulate the pressure level at which the priming valve will open.

4 Claims, 2 Drawing Figures

33a
48
47
39
44
45
32
33
27
35
38
40
46
36
34
43
49
42
53
41
37
28
52
50
54
56
58
51
25
62
57
59
63
67
61
55
68
65
60
64
23
29
29
66
23
17

TEE-TYPE VALVE FOR SELF-PRIMING PUMP SYSTEM

BACKGROUND OF THE INVENTION

This invention relates to self-priming systems for liquid pumps, and more particularly to a self-priming pump system wherein a fast-acting, tee-type priming valve is provided to permit automatic priming of the pump.

Self-priming liquid pumping systems are disclosed in U.S. Pat. Nos. 3,370,604 and 3,381,618, each of which is commonly owned by the assignee of the present invention. As there shown, a pump is positioned so that its suction inlet line is submerged in a suction chamber, and a check valve is provided in the discharge to prevent reverse flow of liquid when suction is lost. A priming valve is positioned between the pump discharge and the check valve to permit the column of liquid therebetween to flow back to the suction chamber and prime the pump.

Previous priming valves included spring-biased valves responsive to liquid dynamic pressure to control the flow of priming liquid to the pump suction inlet. Actuation of the priming valve was by means of a pressure sensing tube which extended into the flow stream, or, alternatively, a venturi was provided to sense the reduced static pressure of the flowing fluid a it passed through the throat of the venturi, and each arrangement caused the priming valve to open when no flow was taking place.

Although the prior art priming valves are entirely suitable for their intended purpose, it is desirable to provide a more rapid acting priming valve construction.

SUMMARY OF THE INVENTION

It is an object of the present invention to provide a rapid acting priming valve which does not incorporate a spring to bias the valve to a predetermined position.

It is another object of the present invention to provide a priming valve wherein the operation of the valve is dependent solely upon fluid pressures existing in the pumping system.

It is still another object of the present invention to provide a priming valve wherein the control of the actuation range of the valve is accomplished externally of the valve structure.

Briefly stated, in accordance with one aspect of the present invention, a self-priming liquid pumping system is provided which incorporates an improved valve structure for providing the priming liquid for a liquid pump. The system includes a pair of check valves positioned downstream of the pump outlet, the fluid between the check valves comprising the priming fluid. Positioned between the two check valves is an improved priming valve in accordance with the present invention, the valve including a valve member having a stem connected to a piston which serve to position the valve member with respect to valve seat. One face of the piston is exposed to the discharge line static pressure and a fluid bleed line extends from the piston chamber to conduct fluid back to the suction tank. A pilot valve is positioned in the bleed line and is adjustable to control the flow which takes place through the piston chamber to the suction tank, to thereby regulate the pressure within the piston chamber and the force acting upon the valve member to urge it into contact with the valve seat.

DESCRIPTION OF THE PREFERRED EMBODIMENTS

Figure 1:
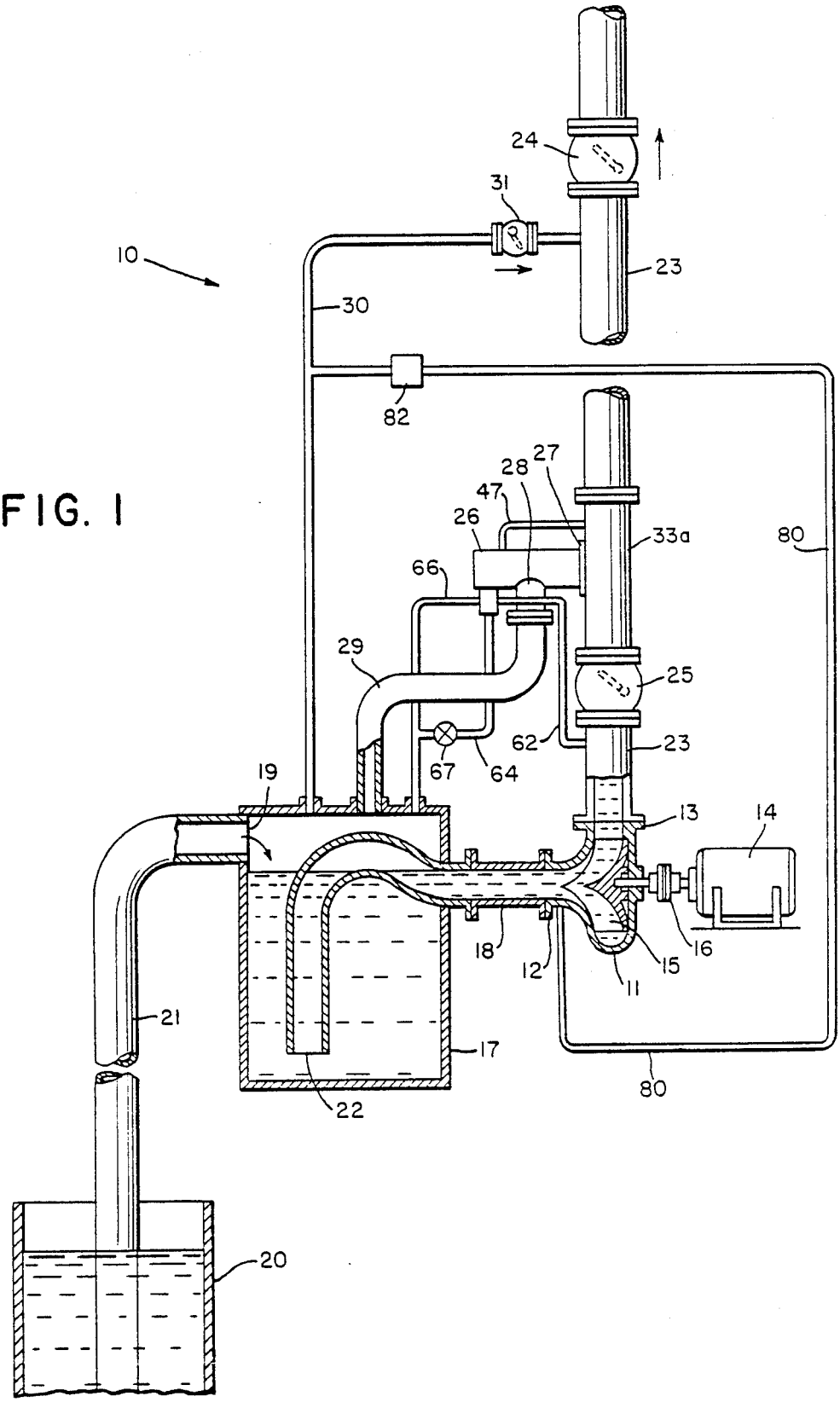
FIG. 1 is a side elevational view, partially in section, illustrating a self-priming system for liquid pumps and incorporating a priming valve in accordance with the present invention.

Referring now to the drawings, and particularly to FIG. 1 thereof, there is shown a fluid system 10 which includes a pump 11 having an inlet 12 and an outlet 13. Although the pump as shown is a single stage pump, a similar horizontally-arranged, multiple stage pump could be provided instead. Pump 11 is driven by an electric motor 14, which is connected to the pump impeller 15 by means of a suitable drive connection 16. A suction tank 17 is connected with pump inlet 12 through inlet line 18. Suction tank 17 includes an opening 19 connected through a pipe 21 to storage tank 20. Inlet line 18 extends into suction tank 17 and terminates in an inlet opening 22. Suction tank 17 is maintained with sufficient liquid from storage tank 20 by virtue of the differential pressure across pipe 21 resulting when liquid is pumped from suction tank 17.

A discharge line 23 extends in a generally vertical direction from pump outlet 13 and includes a first check valve 25 positioned immediately downstream of pump 11 and a check valve 24 positioned downstream of check valve 25 a sufficient distance to provide a column of liquid of predetermined volume. A priming valve 26 is connected to discharge line 23 at tee 33*a* 7and includes an inlet 27 and an outlet 28. A discharge conduit 29 extends from outlet 28 to suction tank 17 to permit priming fluid which passes through valve 26 to flow into suction tank 17 to allow pump 11 to prime itself again. The liquid between check valve 24 and priming valve 26 provides a column of liquid which is of a sufficient quantity to permit priming of the pump.

An air relief conduit 30 extends from suction tank 17 to discharge line 23 immediately upstream of check valve 24 to permit air from suction tank 17 to replace the priming liquid. A relief conduit check valve 31 allows movement of air only toward discharge line 23 in order to prevent liquid from passing through conduit 30. When liquid in discharge conduit 23 is permitted by priming valve 26 to return to tank 17, air in tank 17 is displaced by the priming liquid and passes through relief conduit 30 and check valve 31 to replace the priming liquid in discharge conduit 23. The air cannot return to tank 17, because of check valve 31, and is therefore forced through check valve 24 upon resumption of liquid flow A vent line 80 extends from the eye of pump 11 to relief conduit 30 to vent air which enters the pump when suction is lost. A vent valve 82 is provided in vent line 80 to control the rate and direction of flow through the vent line, as will be hereinafter described.

Figure 2:
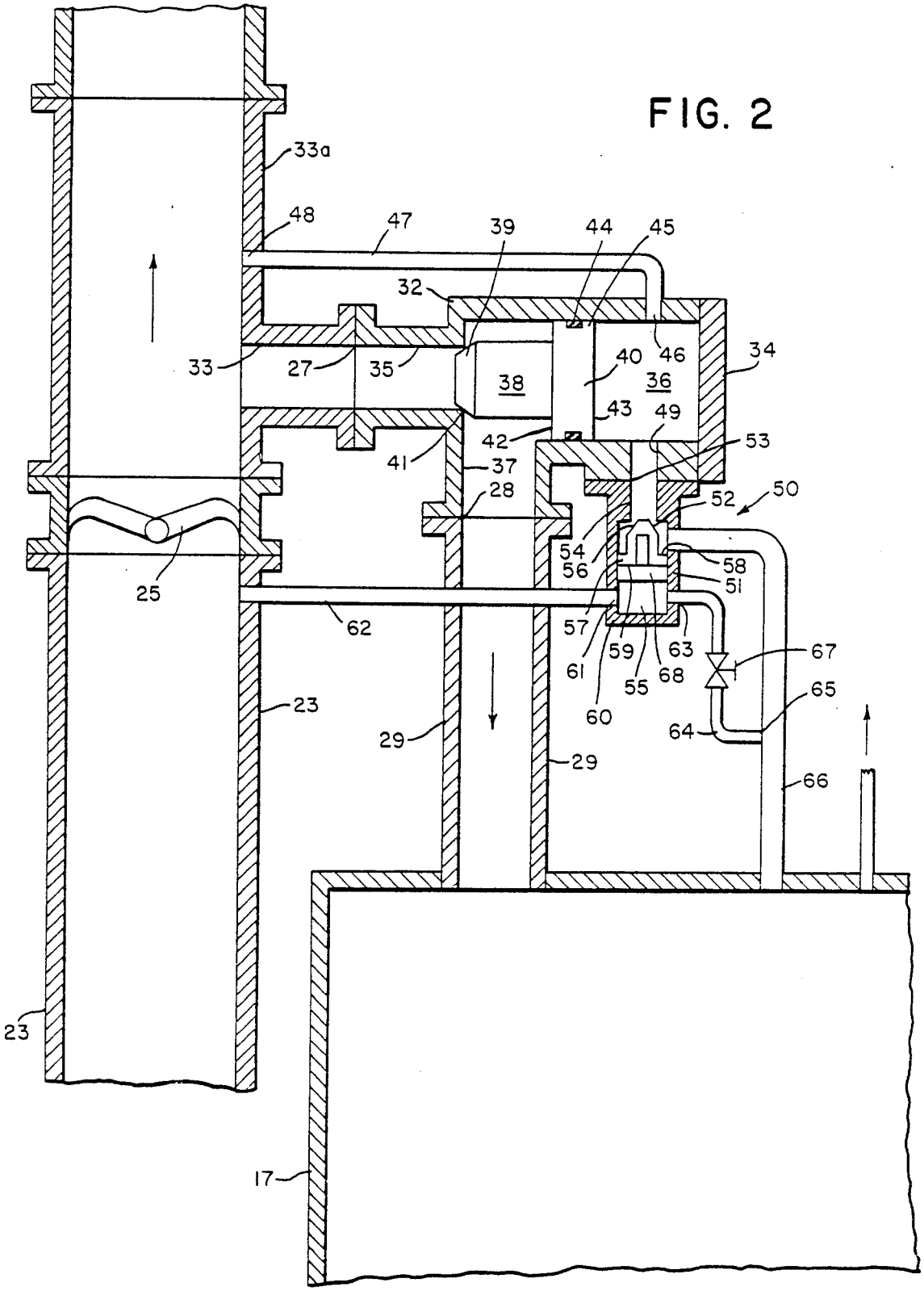
FIG. 2 is a fragmentary cross-sectional view showing one embodiment of a priming valve in accordance with the present invention.

Referring now to FIG. 2, priming valve 26 is in the form of a tee-shaped housing 32. Inlet 27 of priming valve 26 is bolted to a corresponding opening 33 in discharge line 23, and opening 33 can be provided in a tee section 33*a*. Housing 32 is closed at its opposite end by means of an end cap 34, and includes an inlet passageway 35 extending from inlet 27 to an inner chamber 36, which is of cylindrical form and of greater cross-sectional area than that of inlet passageway 35. An outlet passageway 37 interconnects outlet opening 28 and inner chamber 36 to permit communication between inlet 27 and suction tank 17 through valve discharge conduit 29.

Slidably carried within housing 32 is a valve member 38 which includes a valve face 39 positioned at one end thereof and a piston 40 positioned at the other end. Valve face 39 is adapted to selectively block and unblock inlet passageway 35 by seating on or moving from valve seat 41, respectively. Piston 40 has a cross-sectional area which is greater than the opening area of valve seat 41 and includes an inner face 42 and an outer face 43. An O-ring 44 is received in an annular recess in the outer periphery 45 of piston 40.

A first aperture 46 is provided in housing 32 adjacent end cap 34 to receive one end of a first conduit 47, the opposite end of which is positioned in an aperture 48 in discharge line 23 at a point downstream of first check valve 25. A second aperture 49 extends through housing 32 adjacent end cap 34 and communicates with a pilot valve 50.

Pilot valve 50 is of an overall tee-shaped configuration similar to that of priming valve 26, but on a smaller scale, and includes a housing 51 and a valve member 52. An inlet opening 53 and an inlet passageway 54 communicate with an inner chamber 55. Inlet opening 53 of pilot valve 50 communicates with second aperture 49 in inner chamber 36 of priming valve 26. A valve seat 56 is provided in inlet passageway 54 and is blocked or unblocked by valve member 52 to close and open the same, respectively. Valve member 52 includes a piston 57 having an inwardly directed face 58 and an outwardly directed face 59.

A end wall 60 is provided in chamber 55 opposite valve face 56 and a first aperture 61 is provided adjacent end wall 60. A first conduit 62 is connected from aperture 61 to discharge line 23 immediately upstream of check valve 25. A second aperture 63 adjacent end wall 60 is connected by a second conduit 64 to an opening 65 in a priming valve relief conduit 66, which extends from priming valve 26 to suction tank 17. A flow control valve 67, such as a needle valve, is positioned in conduit 64 and controls the pressure exerted on face 59 of piston 57. The cross-sectional area of second conduit 64 is smaller than that of first conduit 62, for reasons which will hereinafter appear. A flexible diaphragm 68 is provided against outwardly directed face 59 of piston 57 to prevent foreign matter from interfering with the smooth movement of piston 57 in chamber 55. It should be noted that diaphragm 68 may very easily be replaced by a suitable bellows or other flexible barrier (not shown).

In the operation of the system, when pump 11 draws liquid from suction tank 17 and pumps it into discharge line 23, the flow opens check valves 24, 25. The static pressure head within discharge line 23 acts upon valve face 39 of priming valve 26 to urge valve member 38 away from valve seat 41 and also acts against outer face 43 of piston 40 by through conduit 47. Because of the cross-sectional area difference, the force exerted on piston 40 exceeds the force exerted on valve face 39 and inlet passageway 35 is closed. Similarly, the same static pressure exerted on outer face 59 of pilot valve piston 57 and on pilot valve face 56 maintains valve member 52 closed to block pilot valve inlet passageway 54. The magnitude of the static pressure acting on pilot valve piston 57 can be controlled by the degree of opening of valve 67, which permits bleed-off of pressure into relief conduit 66 to control the pressure which can be exerted against outer face 59 of pilot valve piston 57.

If the pump exhausts the liquid in suction tank 17, check valves 24 and 25 close to prevent reverse flow in discharge line 23. Because the pressure head upstream of first check valve 25 is zero, because of bleed-off through bleed valve 67, the force exerted by the static pressure acting upon pilot valve face 56 exceeds the force exerted on outer face 59 of pilot valve piston 57. Thus pilot valve member 52 moves away from inlet passageway 54, to open the pilot valve and permit fluid to pass through inner chamber 55 and into relief conduit 66. Second conduit 66 has a cross-sectional area greater than that of first conduit 47, and thus the pressure acting on outer face 43 of piston 40 falls, causing the priming valve to open to permit the column of liquid to return to suction tank 17 through discharge conduit 29 to permit the pump to resume normal operation.

While particular embodiments of the present invention have been illustrated and described, it will be apparent to those skilled in the ar that various changes and modifications can be made without departing from the spirit and scope of the invention, and it is intended to encompass within the appended claims all such changes and modifications which fall within the scope of the present invention.

What is claimed is:

1. In a self-priming pump system including a liquid pump, a suction tank in communication with the pump, a discharge line connected to the pump and including a first check valve positioned downstream of the pump a distance sufficient to provide a column of priming liquid, and a priming valve having an inlet in communication with the discharge line and an outlet in communication with the suction tank and positioned between the pump outlet and the first check valve, the priming valve responsive to liquid flow from the pump to automatically permit flow of the priming liquid from the discharge line to the suction tank when suction at the pump inlet is lost, the improvement comprising:

a. a second check valve positioned between the priming valve and the pump;

b. a piston connected to the priming valve slidably positioned within a cylinder, one face of said piston exposed directly to the discharge line static pressure, and the other face of said piston exposed via the priming valve to the discharge line static pressure;

c. a conduit connecting the one face of the piston to the suction tank;

d. a pilot valve blocking said conduit;

e. a bleed line communicating the rear of said pilot valve and the suction tank;

f. bleed valve means positioned in said bleed line to control the flow of fluid therethrough; and g. a second conduit connecting the discharge line upstream of the second check valve to the rear of the pilot valve.

2. The self-priming pump system of claim 1 wherein said bleed valve means is a needle valve.

3. The self-priming pump system of claim 1 wherein said piston has an area greater than that of the seat of said priming valve.

4. The self-priming pump system of claim 1 wherein the rear of said pilot valve has an area greater than that of the seat of said pilot valve.

* * * * *